US005592927A

United States Patent [19]

Zaluzec et al.

[11] Patent Number: 5,592,927

[45] Date of Patent: Jan. 14, 1997

[54] METHOD OF DEPOSITING AND USING A COMPOSITE COATING ON LIGHT METAL SUBSTRATES

[75] Inventors: Matthew J. Zaluzec, Canton; Robert C. McCune, Jr., Southfield; Oludele O. Popoola, Grand Blanc; James R. Baughman, Plymouth; John E. Brevick, Livonia, all of Mich.

[73] Assignee: Ford Motor Company, Dearborn, Mich.

[21] Appl. No.: 540,147

[22] Filed: Oct. 6, 1995

[51] Int. Cl.[6] ..... F02B 77/02

[52] U.S. Cl. ..... 123/668; 427/453; 427/454; 427/456; 427/449

[58] Field of Search ..... 427/446, 453, 427/454, 456, 449; 123/668

[56] References Cited

U.S. PATENT DOCUMENTS 1,347,476 7/1920 Allyne .
3,900,200 8/1975 Nakamura ..... 277/235 A
3,935,797 2/1976 Niimi et al. ..... 92/223
4,687,578 8/1987 Lindblom ..... 427/453

OTHER PUBLICATIONS

Thermal Spraying: Practice, Theory, and Application, American Welding Society, 1985, pp. 9–10 & 27.

*Primary Examiner*—Katherine A. Bareford
*Attorney, Agent, or Firm*—Joseph W. Malleck

[57] ABSTRACT

Method of depositing an $Fe_xO$ comprising coating onto a light metal substrate by use of wire-arc thermal spraying that propels atomized droplets by use of atomizing gases, comprising: preparing at least one surface of the light metal substrate to present an exposed essentially non-oxidized substrate surface; and thermally spraying melted droplets of a steel feedstock wire onto the prepared surface by use of propellant gases to deposit a composite coating, the gases being controlled as to content to regulate the exposure of the droplets to oxygen so that $Fe_xO$ is substantially the only iron oxide formed during spraying, x being 0.5–1.5.

10 Claims, 4 Drawing Sheets

METHOD OF DEPOSITING AND USING A COMPOSITE COATING ON LIGHT METAL SUBSTRATES

BACKGROUND OF THE INVENTION

1. Technical Field

This invention relates to the technology of providing a wear resisting coating on aluminum or other light metal substrates, and more particularly to the provision of iron based coatings containing a self lubricating phase in the form of $Fe_xO$.

2. Discussion of the Prior Art

To reduce weight and improve fuel efficiency, light weight aluminum block engines are being used more extensively throughout the automotive industry. Although aluminum block engines reduce weight, it is necessary to provide a more wear resistant cylinder bore surface for extended durability. Lightweight aluminum block engines incorporate either cast-in-place or pressed-in-place cast iron liners to provide a wear and scuff resistant cylinder bore surface. Use of cast iron liners for aluminum engine blocks has been known for some time (see U.S. Pat. No. 1,347,476). The functionality of such liners is based on compatibility between a steel piston ring pack in lubricated running contact with the cast iron cylinder bore wall. The tribological properties of grey cast iron make it an excellent material for cylinder bore applications providing the necessary wear and scuff resistance required to insure long-term durability and reliability. Metallurgically, the wear resistance and scuff resistance of grey cast iron can be attributed to the presence of graphite, a self lubricating phase which is uniformly distributed in a wear resistant matrix consisting of alpha-iron (Fe) and iron carbide ($Fe_3C$-cementite) phases. Although aluminum block engines currently incorporate cast iron liners, the cost and complexity associated with cast-in-place or pressed-in-place liner technology make alternative cylinder bore surfacing technology attractive.

Alternative surface technology heretofore has included nickel plating of cylinder bore walls to provide corrosion resistance to iron substrates while offering only limited reduction of friction because of the softness and inadequate formation of nickel oxide (see U.S. Pat. No. 991,404). Chromium or chromium oxide coatings have been selectively used in the 1980s to enhance wear resistant of engine surfaces, but such coatings are difficult to apply, are unstable, very costly, and fail to significantly reduce friction because of their inability to hold an oil film, have high hardness, and often are incompatible with steel piston ring materials. Aluminum bronze coatings have been applied to aluminum engine bores in the hopes of achieving compatibility with steel piston rings.

In the same time period, iron or molybdenum powders have also been applied to aluminum cylinder bore walls in very thin films to promote abrasion resistance. Such systems do not control the oxide form so as to possess a low enough coefficient of friction that would allow for appreciable gains in engine efficiency and fuel economy. For example, (as shown in U.S. Pat. No. 3,900,200) thermally (plasma) sprayed $Fe_3O_4$ particles were deposited onto a cast iron substrate to obtain an increase in wear resistance (scuffing and abrasion resistance). Unfortunately, such coating eliminated the beneficial effect of a self lubricating phase. Similarly, in U.S. Pat. No. 3,935,797, an iron powder coating of 0.3% carbon was plasma sprayed onto an aluminum substrate propelled by a spray of inert gas resulting in an iron and iron oxide coating that inherently contained $Fe_3O_4$ due to the excess of $O_2$ drawn in by the spray action of the propellant. To decrease scuffing, a manganese phosphate coating was needed over the iron and oxide coating.

SUMMARY OF THE INVENTION

It is an object of this invention to provide a method of thermally spraying lightweight metal substrates with a low carbon/low alloy steel wire feedstock, such that the wire melts, is atomized and sprayed so that oxygen is entrained within the spray to kinetically produce iron oxide. The resulting coating should be constituted as a composite of alpha-iron and $Fe_xO$.

The invention in more particularity meets such object by the following steps of: (a) preparing at least one surface of a light metal substrate to present an exposed essentially non-oxidized substrate surface; (b) thermally spraying melted droplets of a steel feedstock wire onto the prepared surface by use of propellant gases to deposit a composite coating, the gases being controlled as to content to regulate the exposure of the droplets to oxygen so that predominantly iron oxide formed during spraying is $Fe_xO$, x being 0.5–1.5. Advantageously: (i) a bond coating may be thermally deposited on the prepared substrate prior to depositing the composite coating, and (ii) the composite coating may be finish smoothed to a uniform thickness of 0.004–0.006 inches.

DETAILED DESCRIPTION AND BEST MODE

Thermally sprayed coatings offer the potential to reduce cost and weight of aluminum block engines through the application of a thin wear resistant coating applied directly to the cylinder bore wall of the aluminum block. Recent developments in thermal spray coating applicators have made it possible to deliver a thermally sprayed coating to the cylinder bore surface of an aluminum block engine using techniques such as two wire arc spray, plasma transferred wire arc spray, combustion flame spray, and high velocity oxygen fuel thermal spray coating processes.

Figure 1:
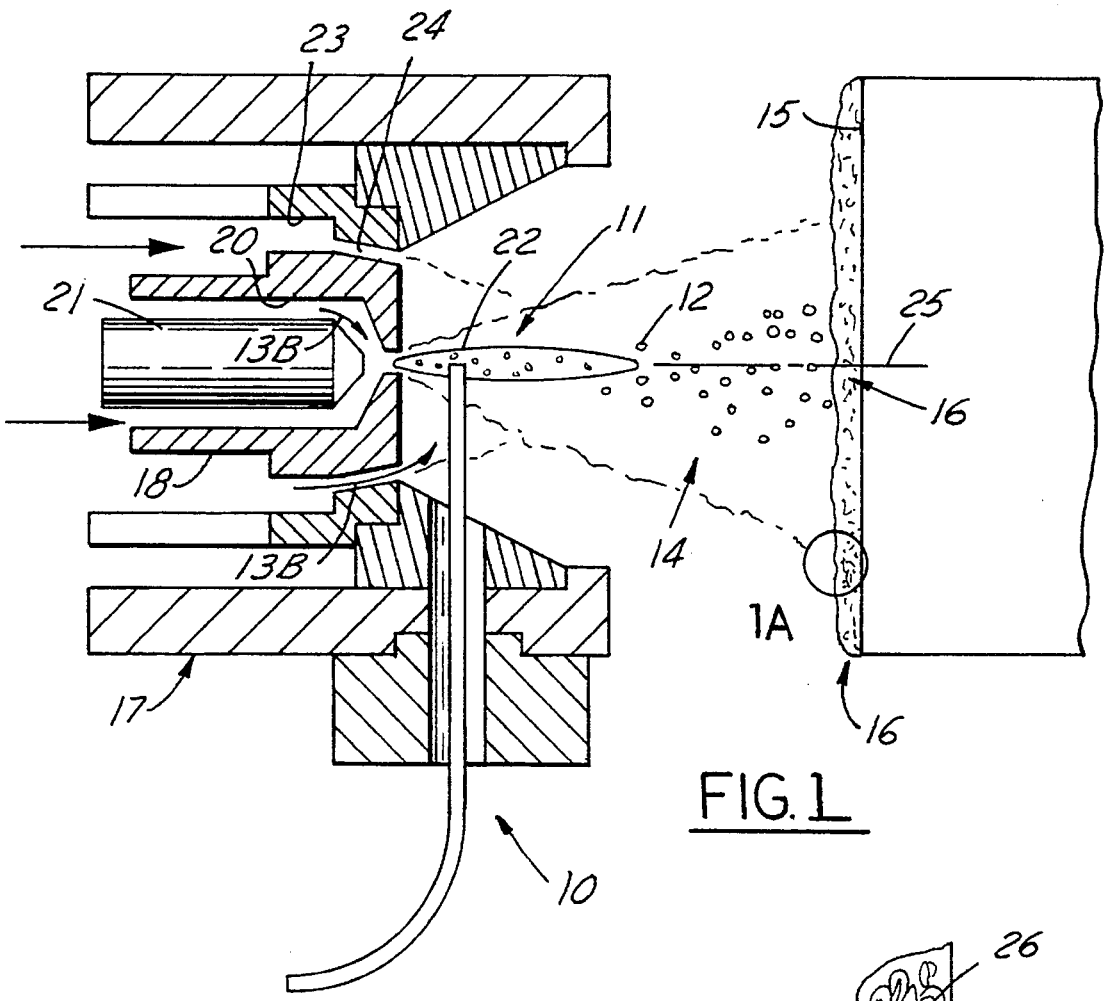
FIG. 1 is a schematic cross-sectional illustration of a wire-arc thermal spray apparatus, (representative of either single wire or two wire arc spraying) using controlled primary and secondary atomizing gases that propel and oxidize iron based particles to form an $Fe/Fe_xO$ composite coating on an aluminum cylinder bore wall in conformity with this invention.
Figure 1A:
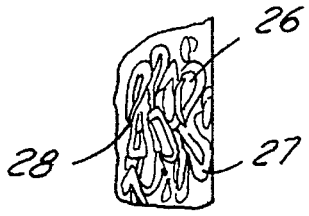
Figure 2:
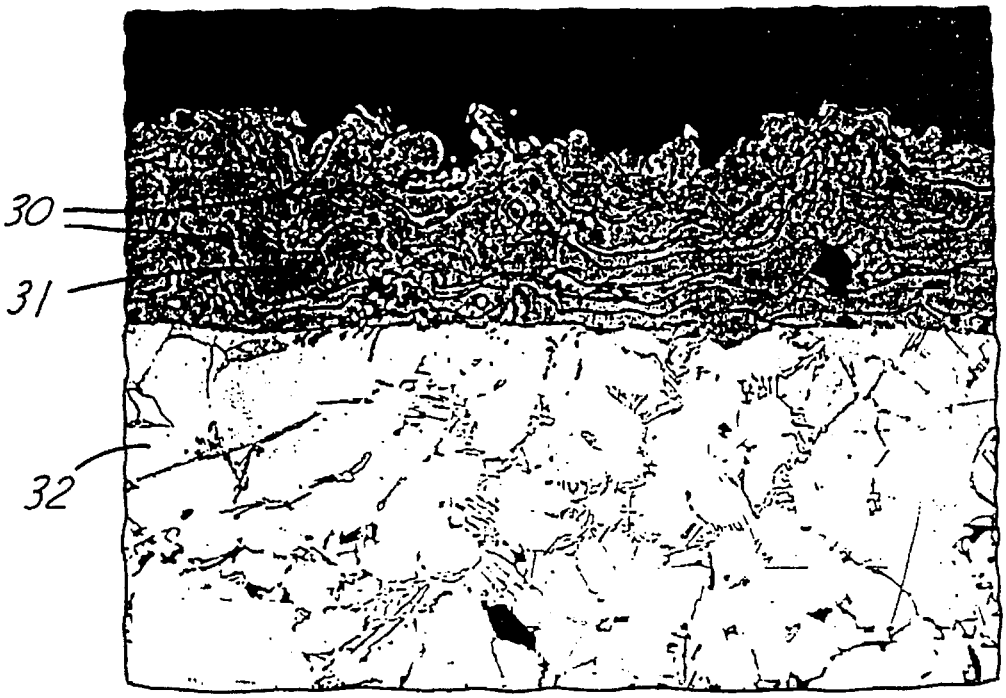
FIGS. 2 and 3 are views (respectively 100× magnification and 400× magnification) of the microstructure of a coating deposited according to FIG. 1, the composite coating containing 5% by volume $Fe_xO$ phase.
Figure 3:
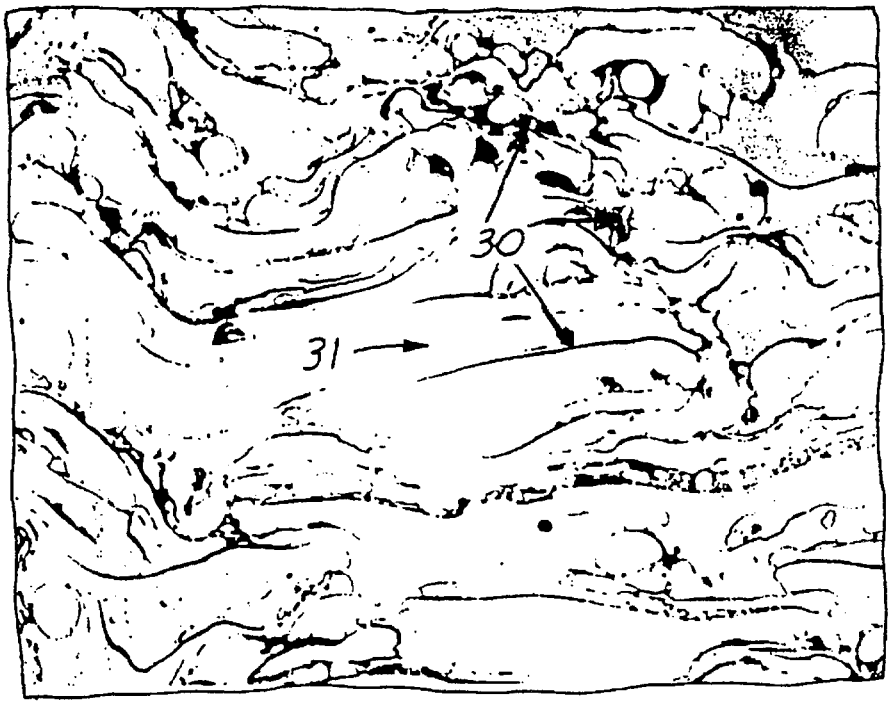
Figure 4:
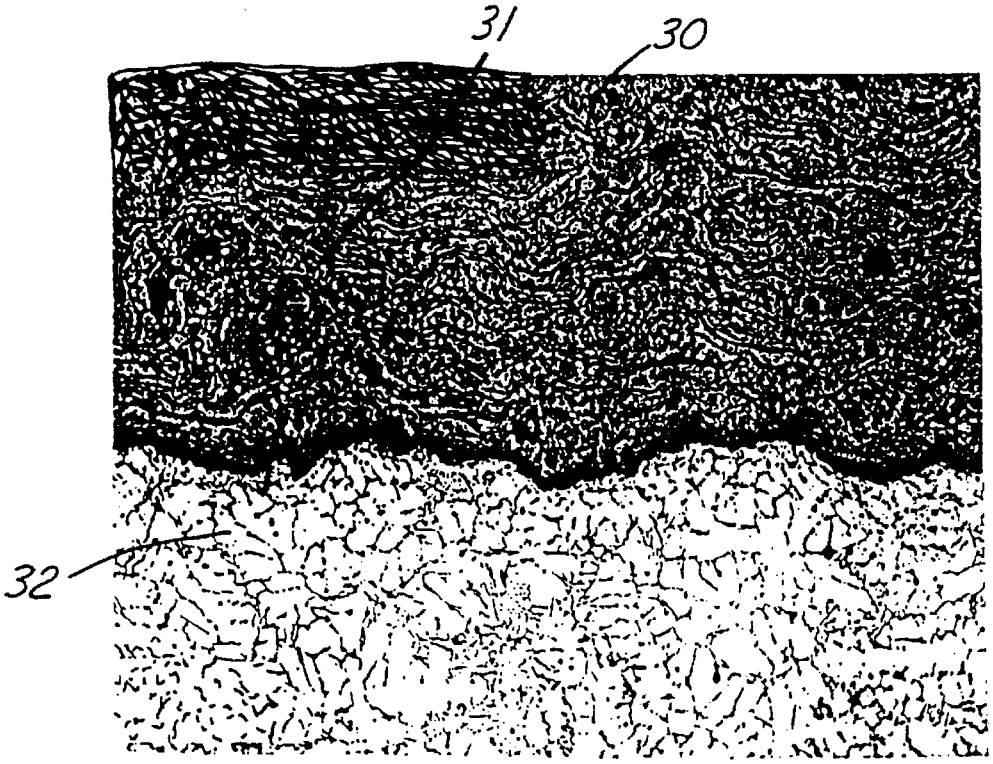
FIGS. 4 and 5 are views (respectively 100× and 400× magnification) of the microstructure of a composite coating deposited according to FIG. 1, containing 30% by volume $Fe_xO$ phase.
Figure 5:
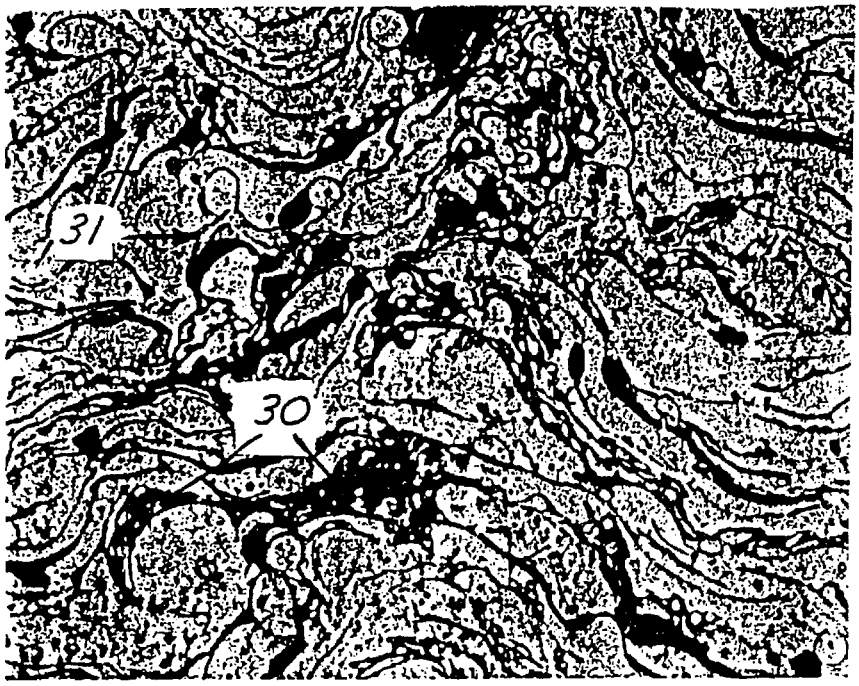

This invention use such techniques to deposit a unique composite coating constituted of $Fe/Fe_xO$, except for alloying ingredients, that possesses self-lubricating properties as well as high wear and scuff resistance in high temperature environments, such as in a combustion chamber or piston-cylinder assembly of an internal combustion engine. As shown in FIG. 1, a low carbon, low alloy steel wire feedstock 10 is fed into the plasma or flame 11 of a thermal gun 17 such that the tip 22 of the feedstock 10 melts and is atomized into droplets 12 by high velocity gas jets 13A and 13B. The gas jets project a spray 14 onto a light metal cylinder bore wall 15 of an engine block and thereby deposit a coating 16. The coating is composed of a generally homogeneous mixture of alpha iron and Wustite ($Fe_xO$) where the $Fe_xO$ phase is formed by oxidation of the melted feedstock during the deposition process. $Fe_xO$ (x being 0.5–1.5) is a hard wear resistant oxide phase which by its nature has a self lubricating property so that the composite coating acts very much like cast iron that includes graphite as a self lubricant.

The gun 17 may be comprised of an inner nozzle 18 which focuses a heat source such as a flame or the plasma plume 11. The plasma plume 11 is generated by stripping of electrons from the primary gas 13A as it passes between the anode 20 and cathode 21 resulting in a highly heated ionic discharge or plume 11. The heat source melts the wire tip 22 and the droplets 12 therefrom are carried by the primary gas 13A at a great velocity. A pressurized secondary gas 13B may be used to further control the spray pattern 14. Such secondary gas is introduced through channels 24 formed between cathode 20 and a housing 23. The secondary gas 13B is directed radially inwardly with respect to the axis 25 of the plume. Melting of the wire 22 is effected by connecting the wire as an anode and striking an arc with cathode 21. The resulting coating 16 will be constituted of splat layers 28 or particles, each having an iron alloy core 26 and a thin shell 27 of $Fe_xO$.

To achieve the results of this invention, two conditions must be met, first the feedstock 10 must be comprised of low carbon, low alloy steel, and secondly the gas flow (here primary and secondary) must be controlled to permit oxygen to react with the droplets 12 to oxidize and form a controlled volume of $Fe_xO$. With respect to the second condition, the gas component can vary between 100% air (or oxygen) and 100% inert gas (such as argon or nitrogen) with respect to oxidization, or any mixture in between. The gas flow rate should be in the range of 30–120 standard cubic feet per minute (SCFM) to ensure enveloping all the droplets and to control the exposure of the steel droplets to such gas. If the gas propellant (gases 13A and 13B) is 100% nitrogen or argon and the flow rate controlled to about 40–80 SCFM, air will be drawn or entrained into the spray pattern by turbulence from the environment (atmosphere in which the gun is being used) in a limited manner. Such air will oxidize the outer surface of the droplets 12 to contain about 5% by volume $Fe_xO$ in the coating. When the propellant gases are constituted of 100% air (or oxygen) and the flow rates again controlled to about 40–80 SCFM, the liquid droplets will be oxidized on their surface to provide an $Fe_xO$ content of about 30% by volume in the coating. When a mixture of air and inert gases is used, the $Fe_xO$ content in the coating will be varied between 5–30% by volume. There will be essentially no other iron oxide form in the coating, other than $Fe_xO$ (Wustite) because of the limited time period for the liquid droplets to react with any surrounding oxygen. Under such oxygen-limited conditions, $Fe_xO$ is reactively preferred and $Fe_2O_3$ and $Fe_3O_4$ either fail to form, or form in incidental quantities.

The chemistry of the steel feedstock used to produce such coatings preferably contains the following alloying ingredients: 0.040–20% by weight carbon, 0.025–0.040% silicon, 0.040–2.0% manganese, 0.02–2.0% chromium, 0.02–2.0% molybdenum, 0.02–4.0% nickel, 0.02–0.50% copper and the balance iron in substantially a non-oxide form. Low carbon steel feedstock material, optimally contains an average of 0.10% by weight carbon, 0.45% manganese, 0.03% silicon, less than 0.50% copper with the balance being iron. Low carbon alloy steel feedstock materials may contain on the average 0.04% carbon, 0.04% silicon, 2.0% manganese, 1.5% chromium, 1.5% molybdenum, 4.0% nickel, 0.50% copper with the balance being iron.

The application of a thermal spray bore coating to the cylinder bore wall of a light metal engine block (such as aluminum, magnesium titanium, and alloys thereof will involve the use of a surface roughening preparation technique such as grit blasting, high pressure water jet erosion, electrode discharge machining, conventional single point machining for roughening, or multiple point honing to achieve desired finish results. Such preparation techniques expose fresh metal that is not oxidized for receiving the thermal spray coating with improved adhesion characteristics. To further enhance the adhesion characteristics of the composite $Fe/Fe_xO$ coating about to be applied, a bond coating may be thermally sprayed or otherwise deposited on to the prepared substrate surface, the bond coating consisting of a soft metal containing the light metal of the substrate. Soft metal is defined herein to mean nickel or bronze, and the light metal is defined herein to mean preferably aluminum, but can include magnesium or titanium. For example, if the substrate is aluminum, the bond coating can consist of an alloy of 95% by weight nickel and 5% aluminum, or 90% bronze and 10% aluminum. Such bond coating may be deposited in a thickness of 0.001–0.008 inches to form a thin layer.

The thermally sprayed coating, according to this invention, is preferably applied in a coating thickness range from 0.016–0.05 inches. Post deposition processing includes machining and honing of the deposit coating to a thickness in the range of 0.004–0.006 inches and will effectively replace the need for a pressed-in-place or cast-in-place cast iron liner. Within such thickness range (0.016–0.05 inches) and $Fe_xO$ content (5–30%), the coatings can be functional as cylinder bore coatings (see the microstructure in FIGS. 2–5). Compare the amount of $Fe_xO$ (30) with the amount of alpha iron (31), the substrate being aluminum (32). Exceeding 30% $Fe_xO$ content in the coating makes the coating difficult to machine; when the $Fe_xO$ content is less than 5% by volume, the coating will not provide adequate wear and scuff resistance.

Figure 6:
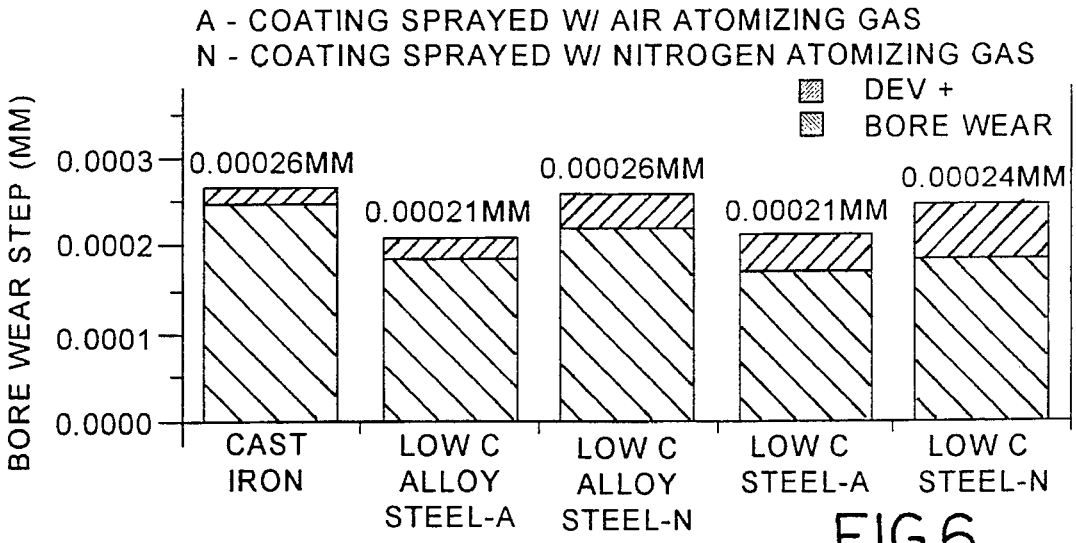
FIG. 6 is a graphical illustration of cylinder bore wear as a function of cylinder bore cast iron content or steel coating content deposited in accordance with this invention.

Coating performance was evaluated using a cylinder bore/piston ring wear bench test under conditions that simulate severe piston ring cylinder bore operating conditions. As shown in FIG. 6, the coatings produced with low carbon and low carbon alloy steel feedstocks and sprayed with air or nitrogen atomizing gases generated different levels of $Fe_xO$ oxide content within the coating but within the 5–30% range. Low carbon and low carbon alloy steel feedstocks deposited using air as the primary atomizing gas produced coatings containing 30% $Fe_xO$ oxide content. Low carbon and low carbon alloy steel feedstocks sprayed using nitrogen as the primary atomizing gas contained 5% by volume $Fe_xO$ oxide content. The cylinder bore coating wear associated with coating feedstock materials containing from 5–30% $Fe_xO$ oxide content, was less than that measured for grey cast iron as shown in FIG. 6.

Figure 7:
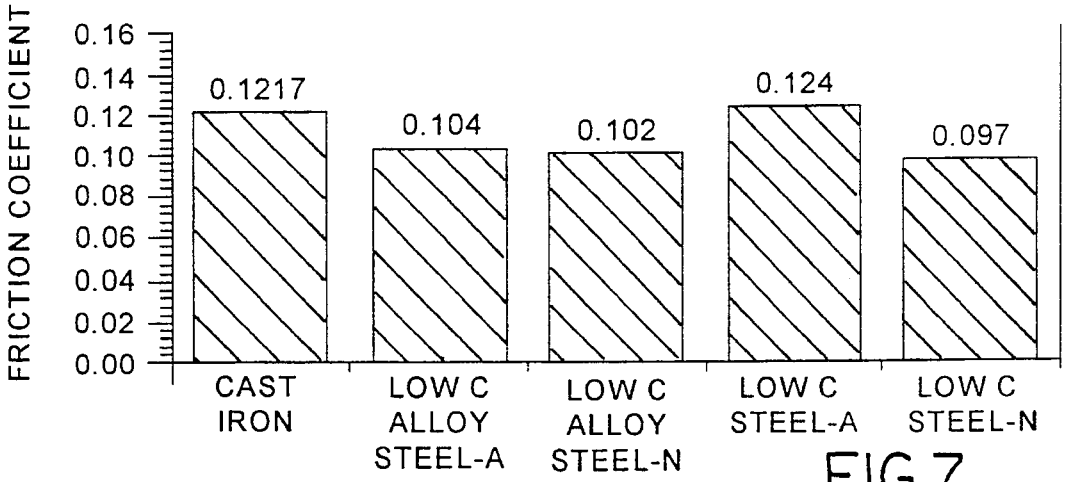
FIG. 7 is a graphical illustration of running contact friction as a function of cylinder bore cast iron content or steel coating content.

The coatings were also evaluated and compared to grey cast iron in a running contact friction bench test. As shown in FIG. 7, the bench test results demonstrated that the wire arc spray coating of $Fe_xO$ was comparable to that of grey cast iron liners.

Figure 8:
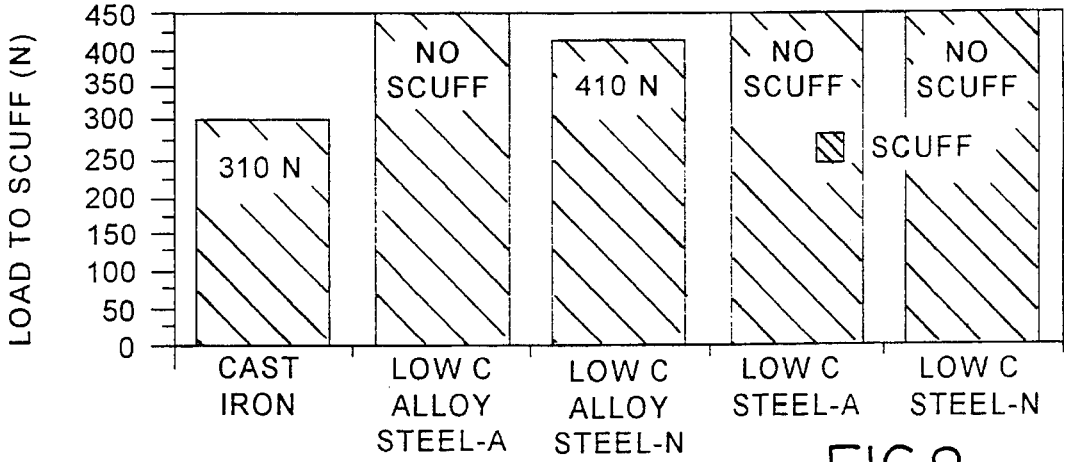
FIG. 8 is a graphical illustration of scuff resistance as a function of cylinder bore cast iron content or steel coating content.

Bench tests were also performed using production 4.6 liter-4 valve compression (top) piston rings running in lubricated contact with the cylinder bore coatings. Such test results indicated the tribology of the coating/piston ring material system is compatible and will not create an in cylinder scuffing problem with respect to hot scuff testing. Wire-arc sprayed $Fe/Fe_xO$ composite coatings outperformed grey cast iron as shown in FIG. 8. This test was conducted by preloading the steel piston rings on the cylinder bore coating and increasing the load with time until scuffing (metal to metal contact) occurred. The $Fe/Fe_xO$ composite coating exceeded the load to scuff resistance of that measured on grey cast iron. In all cases, wire-arc sprayed $Fe/Fe_xO$ composite coatings matched or outperformed grey cast iron with respect to bore wear, running contact friction and hot scuff resistant.

Lastly, the functionality of the coatings were evaluated in engine dynamometer tests designed to evaluate coating durability on parent bore coating of aluminum block engines. Identical tests were run on production 4.6 liter-4 valve engine with pressed-in-place cast iron liners for comparison. Engine performance was evaluated before and after an accelerated engine dynamometer test which included a 50 hour piston and gasket test, a 100 hour thermal shock test, and a 20 hour deep thermal shock test and the piston hot scuff test. The motoring mean effective pressure, as a function of piston speed data from the two wire-arc sprayed 4.6 liter-4 valve engines with a 0.006 inch thick $Fe/Fe_xO$ composite cylinder bore coating was comparable to or better than the performance of the base line 4.6 liter-4 valve engine with production pressed-in-place cast iron liners. Since the mean effective pressure, as a function of piston speed, is an effective comparison of engine operating friction, the performance of the wire-arc coated aluminum block engines were verified to be comparable to that of cast iron lined aluminum engine. Similar results were obtained for power output of the thermal spray coated engine. The horsepower as a function of engine speed of the two wire-arc sprayed engines was comparable to or better than the cast iron lined engine. Coating durability was assessed based on comparative cylinder bore wear after testing. The measured bore wear of the thermal spray coated aluminum block engines, after dynamometer testing, measured on the average of 2.0 micrometers of wear at the top of the bore wall at the piston ring stop, compared to 2.9 microns of wear for the base line cast iron liner engine. Based on this performance, cost savings and weight reduction associated with wire-arc sprayed aluminum block engines in conformity with this invention, possesses many valuable benefits.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of depositing an $Fe_xO$ comprising coating onto a light metal substrate by use of wire-arc thermal spraying that propels atomized droplets by use of atomizing gases, comprising:

(a) preparing at least one surface of said light metal substrate to present an exposed essentially non oxidized substrate surface; and (b) thermally spraying melted droplets of a low carbon (0.04–2% by wt.) steel feedstock wire onto said prepared surface by use of propellant gases at a gas flow rate of 30–120 SCFM to deposit a composite coating, the gases being controlled as to content to regulate the exposure of said droplets to oxygen so that wustite of the formula $Fe_xO$ (Wustite) is the only iron oxide formed during spraying, x being 0.5–1.5, said coating containing said wustite in amount of 5–30% by volume with the balance being iron based of a composition essentially that of the starting feedstock.

2. The method as in claim 1 in which said substrate is aluminum based, and in which a thermally deposited bond coat is applied to said prepared surface prior to step (b) said bond coat being comprised of a soft metal containing aluminum.

3. The method as in claim 2, in which said bond coating consists of about 90% by weight bronze and 10% aluminum.

4. The method as in claim 1, in which said substrate surface is an interior surface of a cylinder bore of an internal combustion engine block.

5. The method as in claim 1, in which said composite coating is smoothed to a thickness of 0.004–0.006 inches.

6. The method as in claim 1, in which said steel of said feedstock wire contains low alloying ingredients of manganese, chromium and/or molybdenum in the range of 0.02–2.0% by weight for each of such ingredient.

7. The method as in claim 1, in which the exposure of step (b) is to a gas comprised essentially of air.

8. The method as in claim 1, in which the exposure to a gas in step (b) is to nitrogen or argon.

9. The method as in claim 1, in which said light metal is selected from the group of aluminum, magnesium, titanium and alloys thereof.

10. Method of using a $Fe/Fe_xO$ composite coated light metal component, comprising:

(a) forming said component as an interior cylinder wall of an internal combustion engine, said wall having a coating adherently bonded thereto by thermally spraying melted droplets of a low carbon (0.04–2.0% by wt.) steel feedstock wire onto said wall by use of propellant gases at a flow rate of 30–120 SCFM to deposit the composite coating, the gases being controlled to regulate the exposure of said droplets to oxygen so that wustite of formula $Fe_xO$ is the only iron oxide formed during spraying, x being 0.5–1.5, the coating containing said wustite in an amount of 5–30% by volume with the balance being iron based on a composition essentially that of the starting feedstock, and (b) subjecting such coated wall to the internal combustion process of an automotive engine, as well as to the reciprocating sliding contact of engine piston rings.

* * * * *